US010280677B2

(12) United States Patent
Burton et al.

(10) Patent No.: US 10,280,677 B2
(45) Date of Patent: May 7, 2019

(54) FRAME ASSEMBLY

(71) Applicant: James Hardie Technology Limited, Dublin (IE)

(72) Inventors: Cordell R. Burton, Sugar Grove, IL (US); Thomas Evan Harris, Medford, WI (US)

(73) Assignee: James Hardie Technology Limited, Dublin (IE)

( * ) Notice: Subject to any disclaimer, the term of this patent is extended or adjusted under 35 U.S.C. 154(b) by 13 days.

(21) Appl. No.: 15/469,378

(22) Filed: Mar. 24, 2017

(65) Prior Publication Data

US 2017/0284150 A1 Oct. 5, 2017

Related U.S. Application Data

(60) Provisional application No. 62/316,292, filed on Mar. 31, 2016.

(51) Int. Cl.

| | |
|---|---|
| ***E06B 1/56*** | (2006.01) |
| ***E06B 1/36*** | (2006.01) |
| ***E06B 3/964*** | (2006.01) |
| ***E06B 3/968*** | (2006.01) |
| ***E06B 1/34*** | (2006.01) |
| ***E06B 1/70*** | (2006.01) |
| ***E06B 3/44*** | (2006.01) |
| *E06B 3/30* | (2006.01) |
| *E06B 1/62* | (2006.01) |

(52) U.S. Cl.

CPC ..... *E06B 1/36* (2013.01); *E06B 1/34* (2013.01); *E06B 1/702* (2013.01); *E06B 3/4415* (2013.01); *E06B 3/964* (2013.01); *E06B 3/968* (2013.01); *E06B 3/9644* (2013.01); *E06B 3/303* (2013.01); *E06B 3/9641* (2013.01); *E06B 3/9681* (2013.01); *E06B 3/9685* (2013.01); *E06B 2001/628* (2013.01); *E06B 2003/4476* (2013.01)

(58) Field of Classification Search

CPC ... E06B 1/34; E06B 1/36; E06B 1/702; E06B 3/964; E06B 3/968; E06B 3/9644

USPC ..... 52/204.55

See application file for complete search history.

(56) References Cited

U.S. PATENT DOCUMENTS 5,491,940 A * 2/1996 Bruchu ..... B29C 65/20 49/504

6,922,958 B2 * 8/2005 Derderian ..... E06B 1/6015 52/204.55

(Continued)

*Primary Examiner* — Charles A Fox

*Assistant Examiner* — James Buckle, Jr.

(74) *Attorney, Agent, or Firm* — Knobbe Martens Olson & Bear, LLP

(57) ABSTRACT

Systems and methods for providing a universal window frame assembly. A window frame assembly can include a plurality of frame members, wherein at least one of the frame members comprises a first profile frame member and at least one of the other frame members comprises a second profile frame member. The at least one first profile frame member and the at least one second profile frame member seat together to form the frame assembly. Head and side jamb members of a window frame can have a common first profile, and a sill jamb member can have a second profile. The frame members can be connected with corner keys configured to engage one or more openings in the first and second profiles. The sill jamb member can provide a sill slope angle.

16 Claims, 10 Drawing Sheets

(56) References Cited

U.S. PATENT DOCUMENTS

| | | | | |
|---|---|---|---|---|
| 7,344,611 | B2 * | 3/2008 | LaSusa | B23P 15/00 156/258 |
| 8,919,056 | B2 * | 12/2014 | Rochman | E06B 1/32 52/204.1 |
| 2009/0199496 | A1 * | 8/2009 | Garries | E06B 1/702 52/213 |
| 2014/0041326 | A1 * | 2/2014 | Kadavy | E06B 7/16 52/209 |
| 2015/0159428 | A1 * | 6/2015 | Johnson | E06B 7/14 49/471 |

* cited by examiner

FRAME ASSEMBLY

CROSS-REFERENCE TO RELATED APPLICATIONS

This application claims the benefit of U.S. Provisional Application Ser. No. 62/316,292, filed Mar. 31, 2016, entitled "A FRAME ASSEMBLY," which is hereby incorporated by reference in its entirety and for all purposes.

BACKGROUND

Field

The present disclosure relates generally to window systems, and more specifically to structural window frame assemblies.

Description of the Related Art

There are several types of window installation methods commonly used in the building industry. The installation method used can be selected based on the type of build being carried out and the needs of the end user. Examples of such methods may include insertion of a window in a window opening of a new construction, insertion of a window where an existing window has been fully removed and is being replaced, insertion of a pocket replacement window wherein the window is manufactured to fit inside an existing window frame such that the top and bottom sash together with some frame components of the existing window are removed, and insertion of a pocket replacement window wherein the window is manufactured to fit inside an existing window frame such that a drywall (e.g., sheet rock, gypsum board or plaster board) return or a jamb extension is retained in place. Each type of installation has its own specific requirements. Typically, different window frame assembly components are required for each installation method.

Any discussion of the prior art throughout the specification should in no way be considered as an admission that such prior art is widely known or forms part of the common general knowledge in the field.

SUMMARY

The systems, methods, and devices described herein address one or more problems as described above and associated with current window frame assembly systems. The systems, methods, and devices described herein have innovative aspects, no single one of which is indispensable or solely responsible for their desirable attributes. Without limiting the scope of the claims, the summary below describes some of the advantageous features.

In some embodiments, the present disclosure provides a universal window frame assembly which is equally suitable for installation in a new construction or as a replacement window assembly. In particular, the jamb components of the universal window frame assembly include a combination of structural features that make the frame assembly equally suitable for installation to a nailing fin (e.g., for a newly constructed window or a full frame window replacement) or in a pocket window replacement (e.g., when replacing component parts of the window assembly, especially in the instance when, for example a sheetrock or dry wall return or a jamb extension is left in place). For example, certain embodiments include both a fin groove configured to receive a nailing fin, and a frame depth between approximately 3 inches and 3.5 inches suitable for installation in a pocket window replacement.

In one such embodiment, a universal window frame assembly is described. The universal window frame assembly includes a head jamb, a sill jamb, a plurality of side jambs, and a plurality of corner keys. The head jamb comprises a first lineal member having a first cross-sectional profile, wherein the first cross-sectional profile includes a first opening, a second opening, and a fin groove configured to securably receive a nailing fin. The sill jamb comprises a second lineal member having a second cross-sectional profile, wherein the second cross-sectional profile includes a planar sill member configured to form an upper surface of the sill jamb, wherein the planar sill member has an exterior end and an interior end defining a frame depth between approximately 3 inches and 3.5 inches, at least one opening disposed below the planar sill member, a flange extending upward from the planar sill member at a position spaced between the exterior end and the interior end, wherein the flange and the sill member intersect at a sill angle, and a fin groove configured to securably receive a nailing fin. The plurality of side jambs comprise a third lineal member and a fourth lineal member, the third and fourth lineal members each having the first cross-sectional profile. Each corner key comprises a first arm configured to seat within one of the first opening or the second opening of the first cross-sectional profile, and a second arm orthogonal to the first arm. The plurality of corner keys include at least one sill corner key in which the second arm is configured to seat within the at least one opening of the second cross-sectional profile to orthogonally couple the sill jamb to one of the side jambs, at least one first head corner key having the first and second arms each configured to seat within the first opening of the first cross-sectional profile to orthogonally couple the head jamb to one of the side jambs, and at least one second head corner key having the first and second arms each configured to seat within the second opening of the first cross-sectional profile to orthogonally couple the head jamb to one of the side jambs.

In some embodiments, the universal window frame assembly further comprises a plurality of cover members each cover member coupled to an inner end of the head jamb, the sill jamb, or one of the side jambs, to form an aesthetically pleasing finish. In some embodiments, the universal window frame assembly is configured to be installed in any of a new construction window, a full frame window replacement, or a pocket window replacement. In some embodiments, the head jamb, the sill jamb, the side jambs, and the corner keys form a substantially rigid rectangular window frame sized and shaped to receive and support one or more slidable window sashes.

In another embodiment, a window frame assembly system is described. The window frame assembly system comprises a head jamb, a plurality of side jambs, a sill jamb, and a plurality of corner keys. The head jamb has a first length defined by a first end and a second end, the head jamb comprising a first cross-sectional profile. Each side jamb has a second length defined by a top end and a bottom end, each side jamb comprising the first cross-sectional profile. The sill jamb has a first end and a second end defining a length equal to the first length, the sill jamb comprising a second cross-sectional profile. Each corner key comprises a first arm and a second arm orthogonal to the first arm, the first arm being sized and shaped to fit within an opening of the first profile.

In some embodiments, the plurality of corner keys comprise at least two sill corner keys and at least two head corner keys, wherein the second arm of each sill corner key is sized and shaped to fit within an opening of the second profile, and wherein the second arm of each head corner key is sized and shaped to fit within an opening of the first profile. In some embodiments, the first arm of each corner key is configured to form a friction-fit connection when inserted into the opening of the first profile. In some embodiments, the head jamb, the side jambs, and the sill jamb each have a depth defined by an interior end and an exterior end, wherein the depth is between approximately 3 inches and 3.5 inches. In some embodiments, each of the head jamb, the side jambs, and the sill jamb comprises a fin groove configured to securably receive a nailing fin of a window opening. In some embodiments, the window frame assembly further comprises one or more cover members configured to couple to an interior surface of at least one of the head jamb, the sill jamb, or the side jambs to form an aesthetically pleasing finish. In some embodiments, the one or more cover members comprise a sill stop configured to couple to the sill jamb, wherein a slope angle of at least a portion of the sill jamb is determined by one or more dimensions of the sill stop. In some embodiments, the head jamb, the sill jamb, the side jambs, and the plurality of corner keys are configured, when assembled, to form a substantially rigid rectangular window frame sized and shaped to receive and support one or more slidable window sashes. In some embodiments, the sill jamb is provides a selectable sill slope angle between 4° and 14°.

In another embodiment, a window frame assembly is described. The window frame assembly comprises a head jamb having a first end and a second end, a plurality of side jambs, each side jamb having a top end and a bottom end, each top end coupled to the first end or the second end of the head jamb, and a sill jamb having a first end and a second end, each of the first end and the second end of the sill jamb being coupled to the bottom end of one of the plurality of side jambs. Each of the head jamb and the side jambs comprises an elongate member having a first cross-sectional profile, and the sill jamb comprises an elongate member having a second cross-sectional profile different from the first cross-sectional profile.

In some embodiments, the first cross-sectional profile comprises a fin groove configured to securably receive a nailing fin of a window opening. In some embodiments, the window frame assembly further comprises a sill stop coupled to the sill jamb, wherein the sill stop is sized and shaped to determine a slope angle of at least a portion of the sill jamb. In some embodiments, each of the head jamb, the side jambs, and the sill jamb comprises an interior end and an exterior end, the interior end and the exterior end being spaced apart by a distance between approximately 3 inches and 3.5 inches. In some embodiments, the window frame assembly further comprises a plurality of corner keys, each corner key comprising at least a first projecting member sized and shaped to fit within an opening of the first profile. In some embodiments, each corner key comprises at least a second projecting member orthogonal to the first projecting member, the second projecting member sized and shaped to fit within an opening of either the first profile or the second profile. In some embodiments, the head jamb, the side jambs, and the sill jamb are coupled by gluing or welding.

In another example embodiment, a frame assembly is described. The frame assembly comprises a plurality of frame members, wherein at least one of the frame members comprises a first profile frame member and at least one of the other frame members comprises a second profile frame member, and wherein the at least one first profile frame member and the at least one second profile frame member seat together to form the frame assembly.

In some embodiments, the frame assembly comprises a window frame assembly.

In some embodiments, the first profile is configured to be used as either a jamb profile or a side profile. In some embodiments, the first profile is configured such that it facilitates insertion of the window frame assembly from either the exterior or interior side of the window opening within the building construction. In some embodiments, the first profile further comprises a channel member or fin groove which is configured to facilitate the optional insertion of a nailing fin member as desired by an end user. One possible advantage of some embodiments is that the first profile of the window frame assembly is easily adapted on site to fit the requirements and needs of either a new window installation or a full or pocket window replacement as desired by the end user.

In some embodiments, the second profile comprises a sill profile which is configured to be used as either a sloped sill or a flat sill. In some embodiments, the sill profile comprises a slope sill wherein the angle of the sill profile is between approximately 4° and 14°. In further embodiments the angle of the sill profile corresponds to a typical sill angle normally associated with window sills. In some embodiments, the sill profile further comprises a sill stop. The sill stop can be configured to adjust the angle of the sill profile such that it moves between a sloped sill and a flat sill. In such embodiments, the angle of the sill is adjustable between approximately 0° and 14°. One possible advantage of an adjustable sill angle is that the second profile of the window frame assembly can be easily adapted on site to fit the requirements and needs of either a new window installation or a full or pocket window replacement having an existing flat or sloped profile as desired by the end user.

In some embodiments, each of the first and second profiles extends from a first end to a second end. In some embodiments, the first end corresponds to the outermost end and the second end corresponds to the innermost end, wherein the outermost end is located on the exterior side of the window frame assembly and the innermost end is located on the interior side of the window frame assembly when the window frame is installed in a building opening. In further embodiments, the distance each of the first and second profiles extends from the first end to the second end corresponds to between approximately 3" (7.62 cm) to 3.5" (8.89 cm)±0.1" (2.54 cm).

An advantage of certain embodiments of the present disclosure is that it provides a universal frame assembly that is suitable for use in various types of window installations. This includes insertion of a window in a window opening of a new construction; insertion of a window, where an existing window has been fully removed and is being replaced; insertion of a pocket replacement window wherein the window is manufactured to fit inside an existing window frame wherein the top and bottom sash together with some frame components of the existing window are removed; and insertion of a pocket replacement window wherein the window is manufactured to fit inside an existing window frame wherein a drywall (sheet rock, gypsum board or plaster board) return or a jamb extension is retained in place. A single universal frame assembly that facilitates different types of window installations can provide many manufacturing and installation efficiencies, including lower complexity within the plant and lower manufacturing costs.

It is acknowledged that the term 'comprise' may, under varying jurisdictions be provided with either an exclusive or inclusive meaning. For the purpose of this specification, the term comprise shall have an inclusive meaning that it should be taken to mean an inclusion of not only the listed components it directly references, but also other non-specified components. Accordingly, the term 'comprise' is to be attributed with as broad an interpretation as possible within any given jurisdiction and this rationale should also be used when the terms 'comprised' and/or 'comprising' are used.

Further aspects or embodiments of the present disclosure will become apparent from the ensuing description which is given by way of example only.

BRIEF DESCRIPTION OF THE DRAWINGS

Certain embodiments of the present disclosure will now be described, by way of example only, with reference to the accompanying drawings. From figure to figure, the same or similar reference numerals are used to designate similar components of an illustrated embodiment.

DETAILED DESCRIPTION

Figure 1:
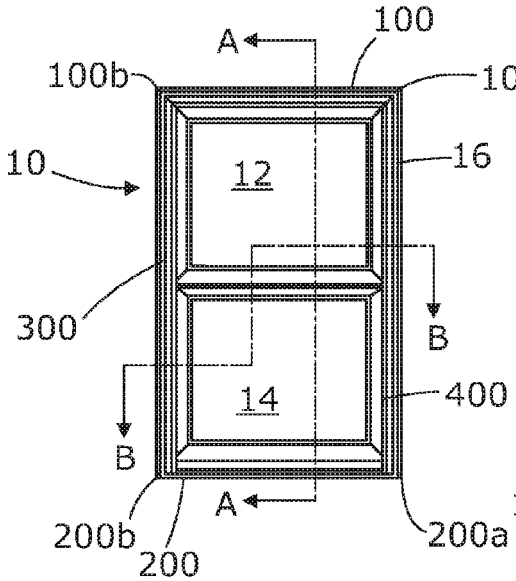
FIG. 1 is a front view of an assembled double-hung window frame assembly.

Although the present disclosure is described with reference to specific examples, it will be appreciated by those skilled in the art that the present disclosure may be embodied in many other forms. The embodiments discussed herein are merely illustrative and do not limit the scope of the present disclosure.

In the description which follows, like parts may be marked throughout the specification and drawings with the same reference numerals. The drawing figures are not necessarily to scale and certain features may be shown exaggerated in scale or in somewhat generalized or schematic form in the interest of clarity and conciseness.

Generally described, the present disclosure provides versatile frame assemblies suitable for installation in a variety of locations. Embodiments of the present disclosure can be implemented in window framing applications including new construction and window replacements in which some or all components of an existing window have been removed. For example, certain frame assembly systems described herein can be equally suitable for installation in new construction, window replacement in which all components of an existing window have been removed, and/or window replacement in which certain components of the existing window remain (e.g., a drywall return, jamb extension, or the like). Thus, the systems described herein can advantageously improve manufacturing efficiency by allowing the same or similar frame assemblies to be used in a variety of window framing implementations. In addition, certain embodiments described herein may further improve manufacturing efficiency by using the same jamb profile for three or four sides of a window frame. Efficiency and ease of installation may be enhanced by using the lineal members and corner keys described below as components of a modular frame assembly system, which may be customizable to fit any desired window opening.

Referring to FIG. 1, there is shown a frame assembly 10 in the form of a window. Frame assembly 10 comprises a plurality of frame members 100, 200, 300 and 400. Each of the frame members 100, 200, 300 and 400 are configured to seat together to form the frame assembly 10. The frame assembly 10 can be installed within a similarly sized opening in a building configured to receive a window frame.

In some embodiments, frame assembly 10 further comprises one or more corner keys, wherein at least a portion of as corner key is configured to seat within at least one pair of adjacent frame members 100, 200, 300 or 400 such that the at least one pair of frame members are securely joined together. The use of corner keys in the frame assembly 10 is optional. For example, in some embodiments the frame members can be secured together to form the frame assembly 10 using any known suitable technique, such as, for example, gluing or welding, without the use of corner keys. In embodiments of the frame assembly 10 that do not include corner keys, each frame member 100, 200, 300 and 400 can be configured during manufacture such that each respective frame member will align with the adjacent frame member to enable each respective frame member to seat together properly to form the frame assembly 10. In further embodiments, corner keys may be used to secure In some embodiments, corner keys are seated at each of the respective corners of the frame members 100, 200, 300 and 400 to secure adjacent frame members. In one example, corner keys are positioned on either end 100*a*, 100*b* of frame member 100 to secure adjacent frame members 300 and 400 to frame member 100, such that frame members 300 and 400 project orthogonally in parallel from frame member 100. Further corner keys are also positioned on either end 200*a*, 200*b* of frame member 200 to secure abutting frame members 300 and 400, projecting orthogonally in parallel from frame member 100, to frame member 200 so as to form a substantially rectangular opening in which at least one window sash can be seated.

In the embodiment shown in FIG. 1, the window frame assembly 10 comprises a substantially rectangular double hung window. The double hung window comprises an upper window sash 12 and a lower window sash 14 slidably mounted within the window frame 16. The upper sash 12 and lower sash 14 slide between at least two positions within window frame 16 to open or close the window frame assembly 10. Although not shown here, it is also possible for the window sash to be held within the window frame in a generally fixed position, thereby forming, for example, a casement window or the like.

In the embodiment shown in FIG. 1, frame members of substantially rectangular window frame 16 include a header or head jamb 100 configured to sit against an upper transverse section of a window opening, a sill or sill jamb 200 configured to sit against a lower transverse section of the window opening, and a pair of spaced apart parallel side jambs 300, 400, configured to sit against spaced apart parallel vertical posts or side sections of the window opening.

Thus, some embodiments of the present disclosure advantageously provide a universal frame assembly that is suitable for use in various types of window installations. As outlined above, this includes insertion of a window in a window opening of a new construction, insertion of a window where an existing window has been fully removed and is being replaced, insertion of a pocket replacement window wherein the window is manufactured to fit inside an existing window frame, and insertion of a pocket replacement window wherein the window is manufactured to fit inside an existing window frame wherein a drywall (sheet rock, gypsum board or plaster board) return or a jamb extension is retained in place.

In some embodiments, some or all of the components of the window frame assembly 10 are provided with hydrophilic or hydrophobic surface treatments to facilitate water management and direct water away from the window frame assembly. In such embodiments, the window frame assembly 10 can advantageously be integrated with and/or form a part of a water management system, weather resistant barrier, rain screen system, or the like.

Figure 2:
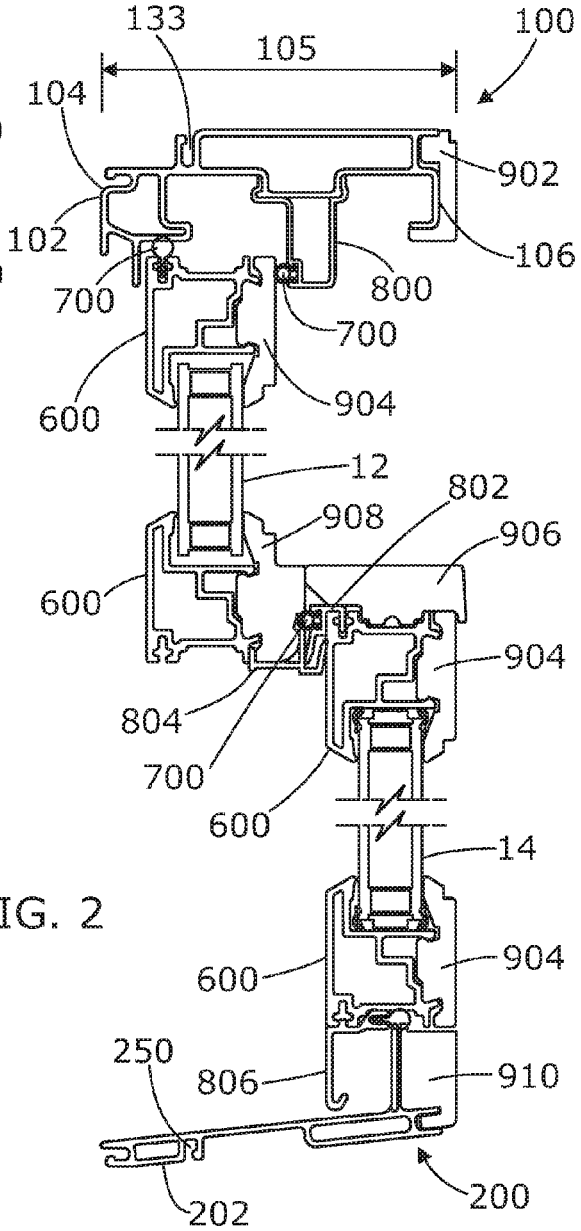
FIG. 2 is a cross-sectional view of the assembled double hung window frame assembly of FIG. 1 along the lines A-A.
Figure 3:
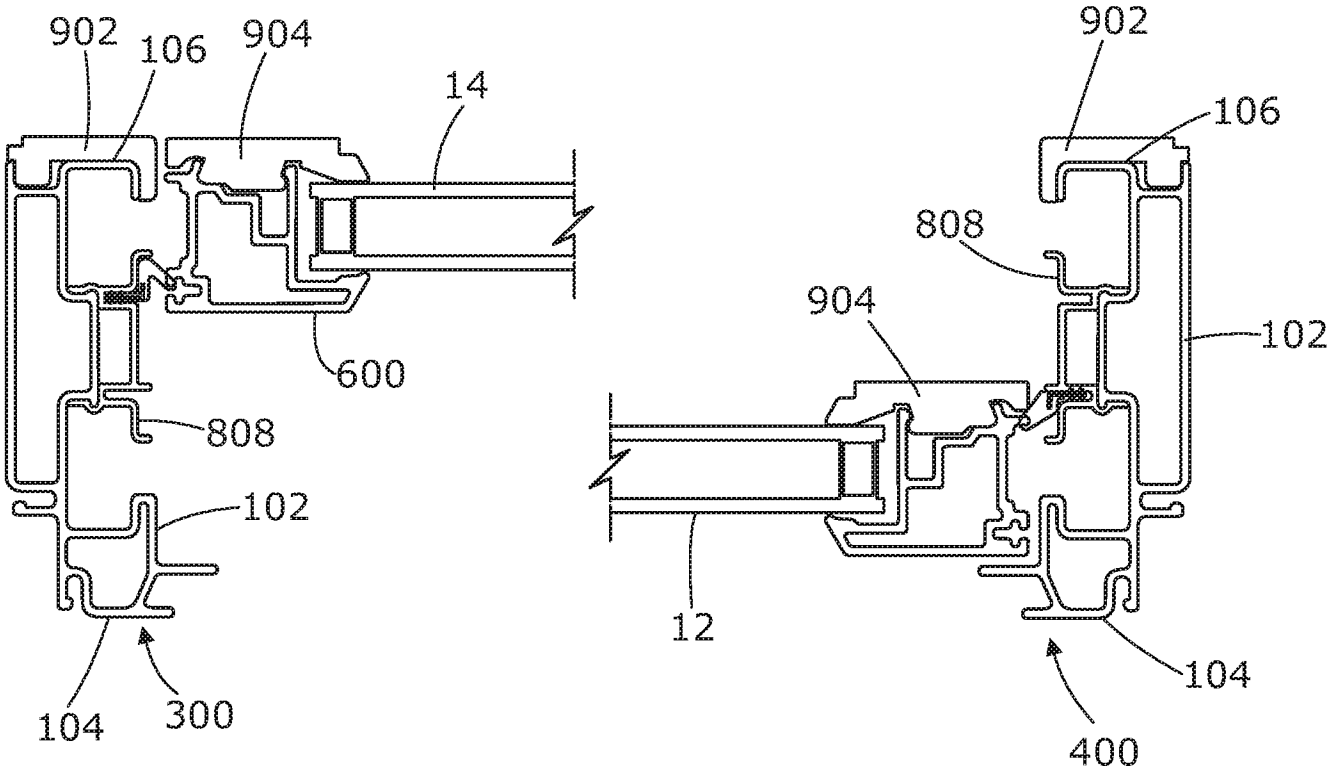
FIG. 3 is a cross-sectional view of the assembled double hung window frame assembly of FIG. 1 along the lines B-B.

FIG. 2 is a cross-sectional view of the frame assembly 10 taken along line A-A of FIG. 1. FIG. 3 is a cross-sectional view of the frame assembly 10 taken along line B-B of FIG. 1. Referring jointly to FIGS. 2 and 3, the cross-sectional views show the profiled components of the head jamb 100, sill jamb 200, and side jambs 300, 400 of window frame 10. Also shown are the profile components of the upper sash 12 and lower sash 14.

In the embodiment depicted in FIGS. 2 and 3, the first profile or jamb profile 102 is used in the head jamb 100 and in each of parallel spaced apart side jambs 300 and 400 of frame assembly 10. Conveniently, when a window frame assembly 10 (as shown in FIG. 1) is installed in a building opening, the innermost end 106 of jamb profile 102 is usually located within the interior of the building in which the window frame assembly 10 is installed, i.e. on the interior side of the window frame assembly 10. Similarly, the outermost end 104 of jamb profile 102 is located on the exterior side of the window frame assembly 10 when the window frame assembly 10 is installed in a building opening.

Figure 4A:
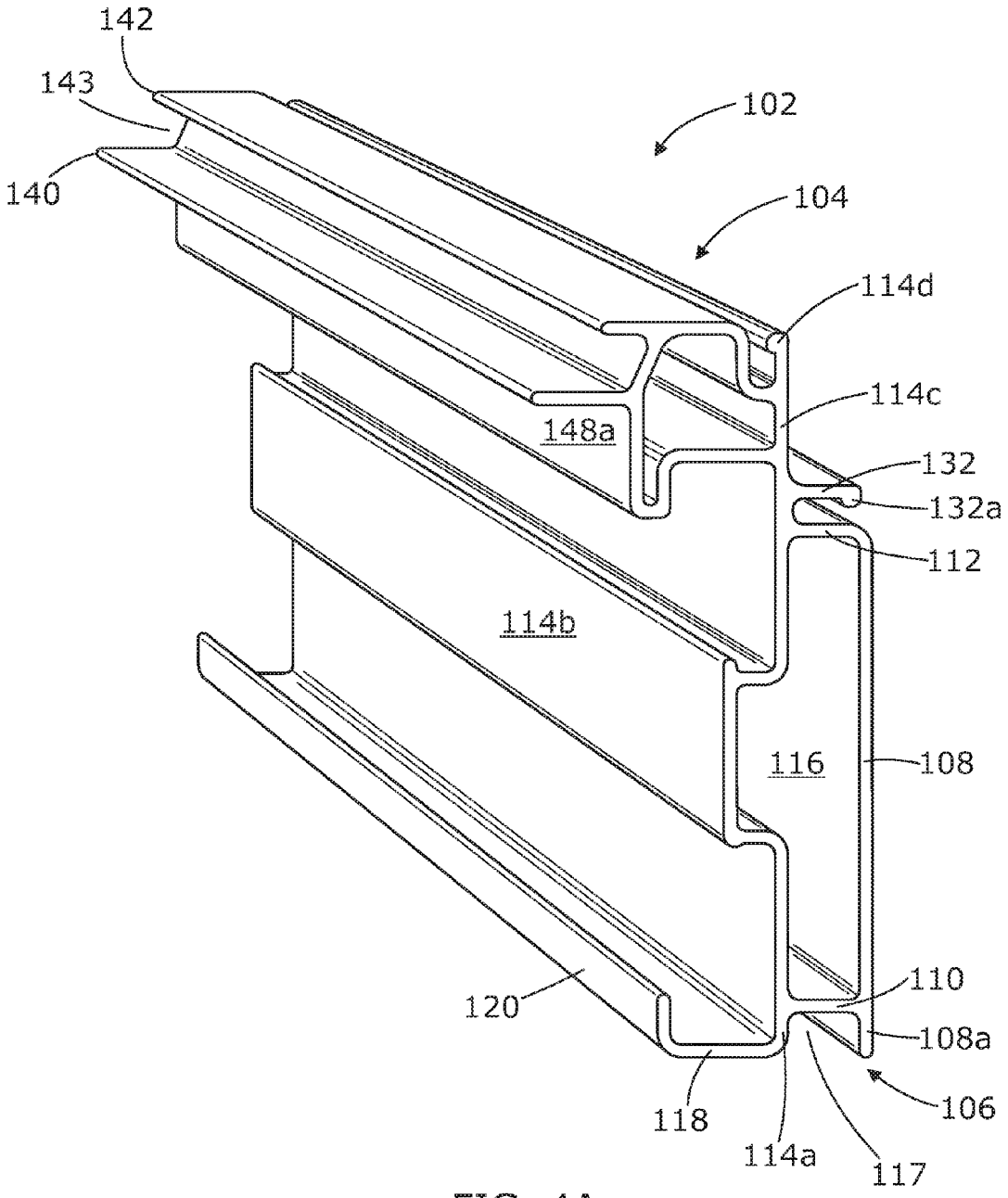
FIG. 4A is an enlarged perspective view of a first lineal member of the frame assembly of FIG. 1.
Figure 4B:
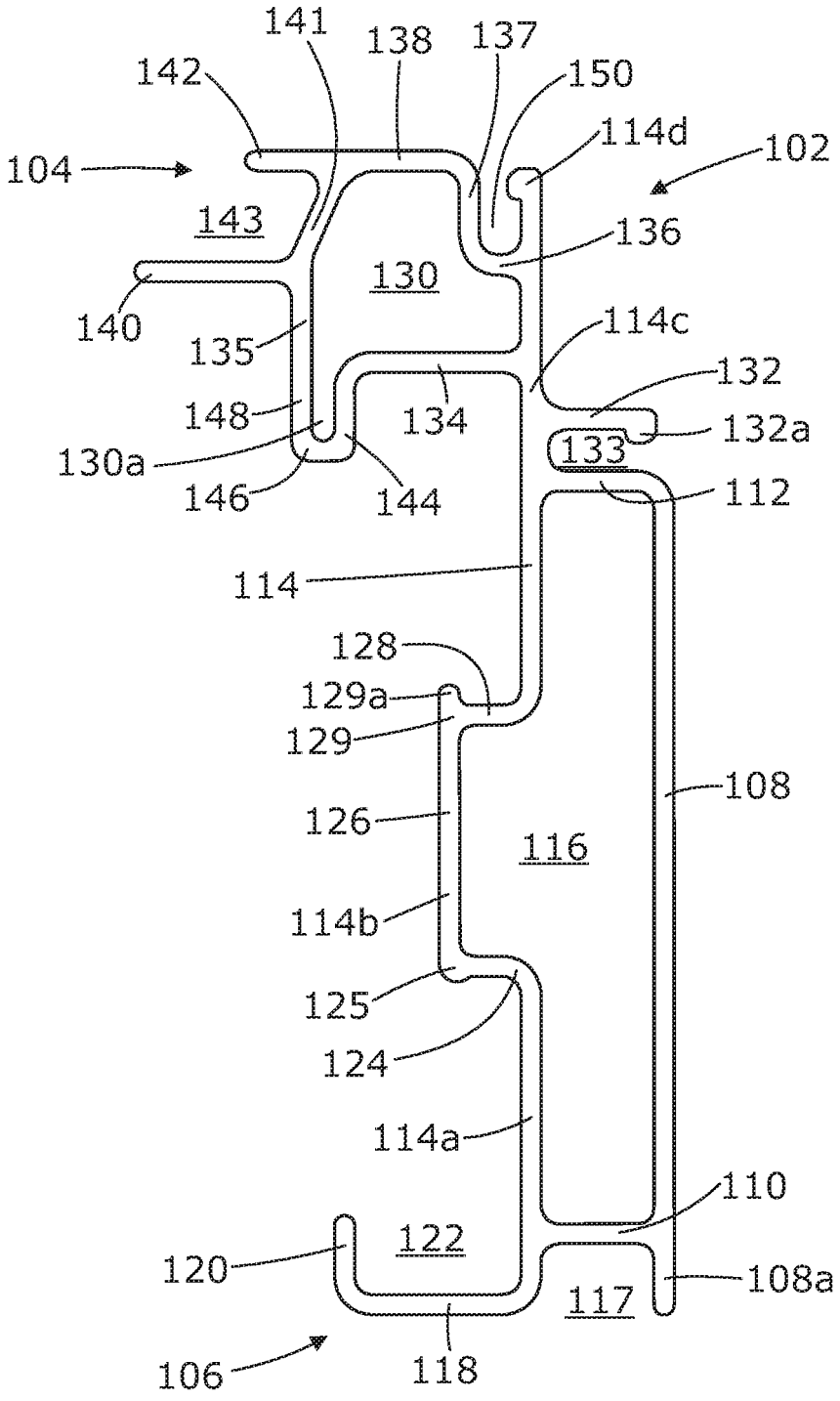
FIG. 4B is a side view of the first lineal member of the frame assembly of FIG. 4A.

Referring now to FIGS. 4A and 4B, the structural components of the first profile or jamb profile 102 will now be described in greater detail. The jamb profile 102 is depicted in a perspective view in FIG. 4A, while FIG. 4B shows an end view of the jamb profile 102. As described above, the jamb profile 102 can be used for any of a head jamb and side jambs in a window frame assembly. The jamb profile 102 is an elongate profile which is sized and configured such that it can seat directly against a window opening in a new construction or where an existing window has been fully removed and is being replaced so as to fill the window opening. The jamb profile 102 is also sized and configured such that it is suitable for use where a drywall (sheet rock, gypsum board or plaster board) return or a jamb extension is retained in place when removing and replacing an existing window or when a pocket replacement window or sash replacement is required.

The ability to use the same jamb profile 102 in the frame assembly when fitting a new window or replacing an existing window is advantageous as it provides for manufacturing and installation efficiencies, for example, by reducing or eliminating a need to manufacture different profiles for use in the different installation environments as described above.

Jamb profile 102 has a first planar section 108 which seats against the perimeter of a window opening, either at the upper transverse section or head of the window opening, or at the vertical posts or side sections of the window opening as appropriate. In an example embodiment, the first planar section 108 extends between approximately 3" (7.62 cm) and 3.5" (8.89 cm)±0.1" (2.54 cm) from the outermost end 104 and the innermost end 106. Typically a pocket replacement window may extend approximately 3.25" (8.26 cm) from the exterior surface of the pocket replacement window to the interior surface of the pocket replacement window. In some embodiments, jamb profile 102 is sized such that the distance the first planar section 108 extends between the outermost end 104 and the innermost end 106 corresponds to the distance that a pocket replacement window extends, that is, approximately 3.25" (8.26 cm). This allows an end user to fit the window frame assembly 10 inside an existing window frame.

In further embodiments, the frame assembly 10 can further include one or more extension members. In use, extension members can abut the jamb profile 102 to extend the distance the frame assembly extends from the exterior surface of a replacement window to the interior surface of a replacement window as desired by an end user.

The jamb profile 102 further comprises a second substantially planar section 114. The second substantially planar section 114 includes a first planar portion 114*a*, a substantially 'c'-shaped section 114*b*, and a second planar portion 114*c*. The substantially 'c'-shaped section 114*b* is positioned intermediate first planar portion 114*a* and second planar portion 114*c*.

First and second segments 110 and 112 extend between the first planar section 108 and the second substantially planar section 114. Thus, the first segment 110, the second segment 112, the first planar section 108, and the second substantially planar section 114 surround and define an opening 116.

In some embodiments, the opening 116 extends along the length of the profile 102 between opposing ends 100*a*, 100*b* (FIG. 1) of frame member or head jamb 100 to form an enclosed interior passage between opposing ends 100*a*, 100*b* of head jamb 100. It is to be understood that opening 116 similarly extends between opposing ends of each of parallel spaced apart side jambs 300 and 400 as shown in FIG. 1.

In certain embodiments, it is possible for a portion of the enclosed interior passage (e.g., opening 116) to be filled with a suitable material, for example, an insulating material in order to enhance the thermal insulation or efficiency of the frame assembly 10 of FIG. 1. In such an embodiment, it may be preferable to form an opening 116 at opposing ends of the jamb profile, as will be described in greater detail below.

The first planar section 108 includes a first wall 108*a* which extends further than the juncture between first planar section 108 and first segment 110, towards the innermost end 106. The first wall 108*a*, first segment 110 and a part of first planar portion 114*a* together form a 'u'-shaped channel 117. The 'u'-shaped channel 117 extends along the length between opposing ends 100*a*, 100*b* (FIG. 1) of frame member or head jamb 100 to form a first receiving channel between the opposing ends 100*a*, 100*b* of the head jamb 100.

With continued reference to FIGS. 4A and 4B, a projection 118 extends from the end of first planar portion 114*a* remote from the substantially 'c'-shaped section 114*b* (e.g., from the end of first planar portion 114*a* nearest the innermost end 106 of the profile 102). The projection 118 extends substantially orthogonally from the first planar portion 114*a*. The projection 118 further comprises a second projection 120 which extends substantially orthogonally from projection 118 remote from the first planar portion 114*a* such that the first planar portion 114*a*, the projection 118, and the second projection 120 together define a substantially 'J'-shaped (e.g., being defined by a base and two parallel legs of significantly different lengths) receiving channel 122. The 'u'-shaped channel 117 and the substantially 'J'-shaped receiving channel 122 are sized and shaped to accommodate a cover member 902 (shown in FIGS. 2 and 3). In the instance where the cover member 902 is used in conjunction with the head jamb 100 of FIG. 1, the cover member 902 is referred to as a head stop. In the instance where cover member 902 is used in conjunction with side jambs 300, 400 of FIG. 1, the cover member 902 is referred to as a side stop.

In an example embodiment, the distance jamb profile 102 and cover member 902 extends from the exterior side of the window frame assembly 10 (FIG. 1) to the interior side of the window frame assembly 10 is between approximately 3.9" (9.9 cm) and 4.4" (11.2 cm)±0.1" (0.25 cm). In another example embodiment, the distance jamb profile 102 and cover member 902 extend from the exterior side of the window frame assembly 10 (FIG. 1) to the interior side of the window frame assembly 10 is approximately 4.13" (10.5 cm) as shown by distance 105 in FIG. 2.

The substantially 'c'-shaped section 114*b* of the second substantially planar section 114 comprises a planar member 126, a first orthogonally projecting member 124, and a second orthogonally projecting member 128. The first and second orthogonally projecting members 124, 128 project respectively from opposing first and second ends 125, 129 of the planar member 126 substantially in parallel with each other such that the planar member 126 and the first and second orthogonally projecting members 124, 128 correspond to the base 126 and the side members 124, 128 respectively of the substantially 'c'-shaped section 114*b*. In the embodiment shown, the first end 125 of planar member 126 is enlarged, and the second end 129 of the planar member 126 comprises a nub 129*a* to provide a resilient fit for connecting members 800, 808 (as shown in FIGS. 2 and 3) respectively.

Figure 5:
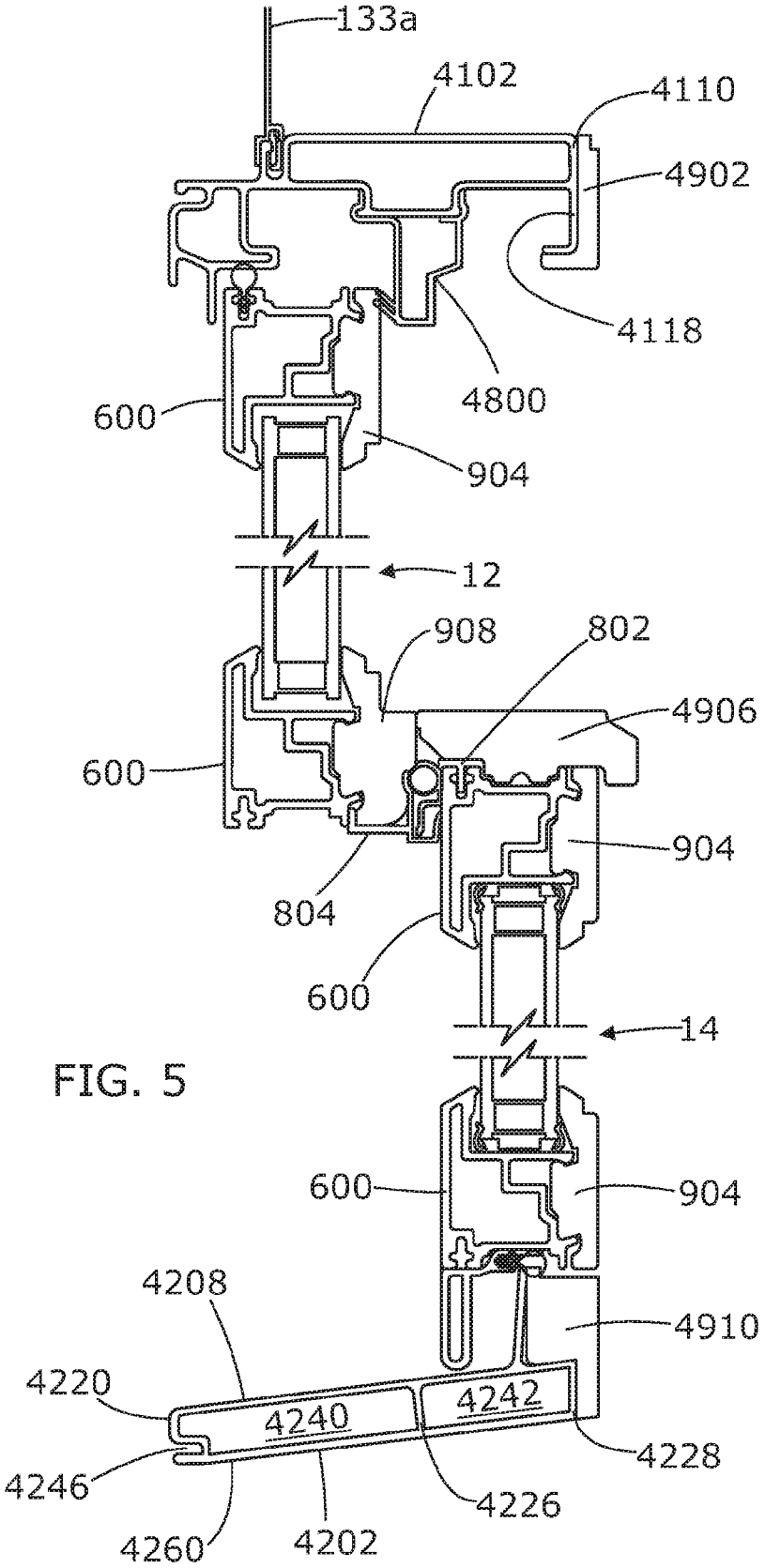
FIG. 5 is a cross-sectional view of a further embodiment of the assembled double hung window frame assembly of FIG. 1 along the lines A-A.

Referring now to the second planar portion 114*c* and the outermost end or shoulder 104, the second planar portion 114*c* comprises a first extension 132 which extends from the second planar portion 114*c* substantially in parallel with the second segment 112 such that the first extension 132, the second segment 112, and a section of the second planar portion 114*c* together define a second elongate u'-shaped receiving channel 133. The second elongate 'u'-shaped receiving channel 133 is also known as a fin groove, and can be configured to receive a nailing fin member (e.g., nailing fin member 133*a* as shown in FIG. 5). A nailing fin member may be coupled to an interior surface of a window opening so as to secure the window frame assembly in position when installed. In the embodiment shown, the first extension 132 further comprises a flange 132*a* which is provided to help retain a nailing fin member within the second 'u'-shaped receiving channel 133 when in place. The nailing fin member (e.g., nailing fin member 133*a* of FIG. 5) can be inserted when desired by an end user when inserting a new window or an entire replacement window.

A second 134 and a third extension 136 also extend substantially orthogonally from the second planar portion 114*c* in the opposite direction to that of first extension 132. A bridging portion 135 extends from the end of the second extension 134 remote from the second planar portion 114*c*. The bridging portion 135 connects the end of the second extension 134 remote from the second planar portion 114*c* with the end of the third extension 136 remote from the second planar portion 114*c* such that a second opening 130 is defined between the second extension 134, the third extension 136, and the bridging portion 135.

Similar to the first opening 116, the second opening 130 also extends along the length of frame member or head jamb 100 of FIG. 1 to form an enclosed passage between opposing ends 100*a*, 100*b* (FIG. 1) of the head jamb 100. As before, it is possible for a portion of the enclosed passage to be filled with a suitable material, for example, an insulating material in order to enhance the thermal insulation or efficiency of the frame assembly 10 (FIG. 1).

The bridging portion 135 comprises a plurality of continuous members 137, 138, 141, 144, 146 and 148 which, together with a first protuberance 140 and a second protuberance 142, define a plurality of seating channels 148*a*, 143 and 150 for one or more further components of the window frame assembly 10 as outlined below. Each of the continuous members 137, 138, 141, 144, 146 and 148 correspond to sections of the bridging portion 135 and are adjoined to each such that the bridging portion 135 is a continuous section between the end of the second extension 134 remote from the second planar portion 114*c* and the end of the third extension 136 remote from the second planar portion 114*c*.

The bridging portion 135 comprises first, second and third continuous sections 144, 146 and 148 at the end of second extension 134 remote from second planar portion 114*c*. First continuous section 144 extends substantially orthogonally in a first direction from the end of second extension 134 remote from second planar portion 114*c*. Second continuous section 146 extends substantially orthogonally from first continuous section 144 in a second direction. Third continuous section 148 extends substantially orthogonally from second continuous section 146 in a third direction which is substantially parallel to the first direction of first continuous section 144. First, second and third continuous sections 144, 146 and 148 together define a substantially 'u'-shaped channel portion 130*a* of opening 130. Conveniently, the surface 148*a* of the third continuous section 148 remote from the substantially 'u'-shaped channel portion 130*a* provides a surface on which a weather strip 700 (as shown in FIG. 2) can be seated against when a sash profile 600 (as shown in FIG. 2) is seated within the window frame assembly 10 (FIG. 1).

The bridging portion 135 further comprises a fourth continuous member 141 which extends from the third continuous member 148. The fourth continuous member 141 is disposed between the third continuous section 148 and the sixth continuous section 138. The first and second protuberances 140 and 142 extend orthogonally from the fourth continuous member 141 such that the first and second protuberances 140 and 142, together with the fourth continuous member 141, define the channel 143, which is configured to receive a window or insect screen (not shown) in the window frame assembly 10 (FIG. 1).

The bridging portion 135 further comprises the fifth and sixth continuous sections 137 and 138. The fifth continuous section 137 extends substantially orthogonally from the end of the third extension 136 remote from the second planar portion 114*c*, and the sixth continuous section 138 extends substantially orthogonally from the end of the fifth continuous section 137 substantially in parallel with the third extension 136. The sixth continuous section 138 adjoins the fourth continuous section 141.

The second planar portion 114*c*, the third extension 136, and the fifth continuous section 137 together define an elongate track or opening 150 which is configured to seat other components or accessories within the window frame assembly 10 (FIG. 1). In some embodiments, other components or accessories include, for example, trim and/or frame expander devices or other suitable accessories known to a person skilled in the art. In one example, an end user may desire to insert an aluminum trim or a fiberglass frame expander. The second planar portion 114*c* further comprises an obtrusion 114*d* which is used to help retain a component or accessory within the elongate track or opening 150 when one is placed within the elongate track or opening 150.

Figure 6:
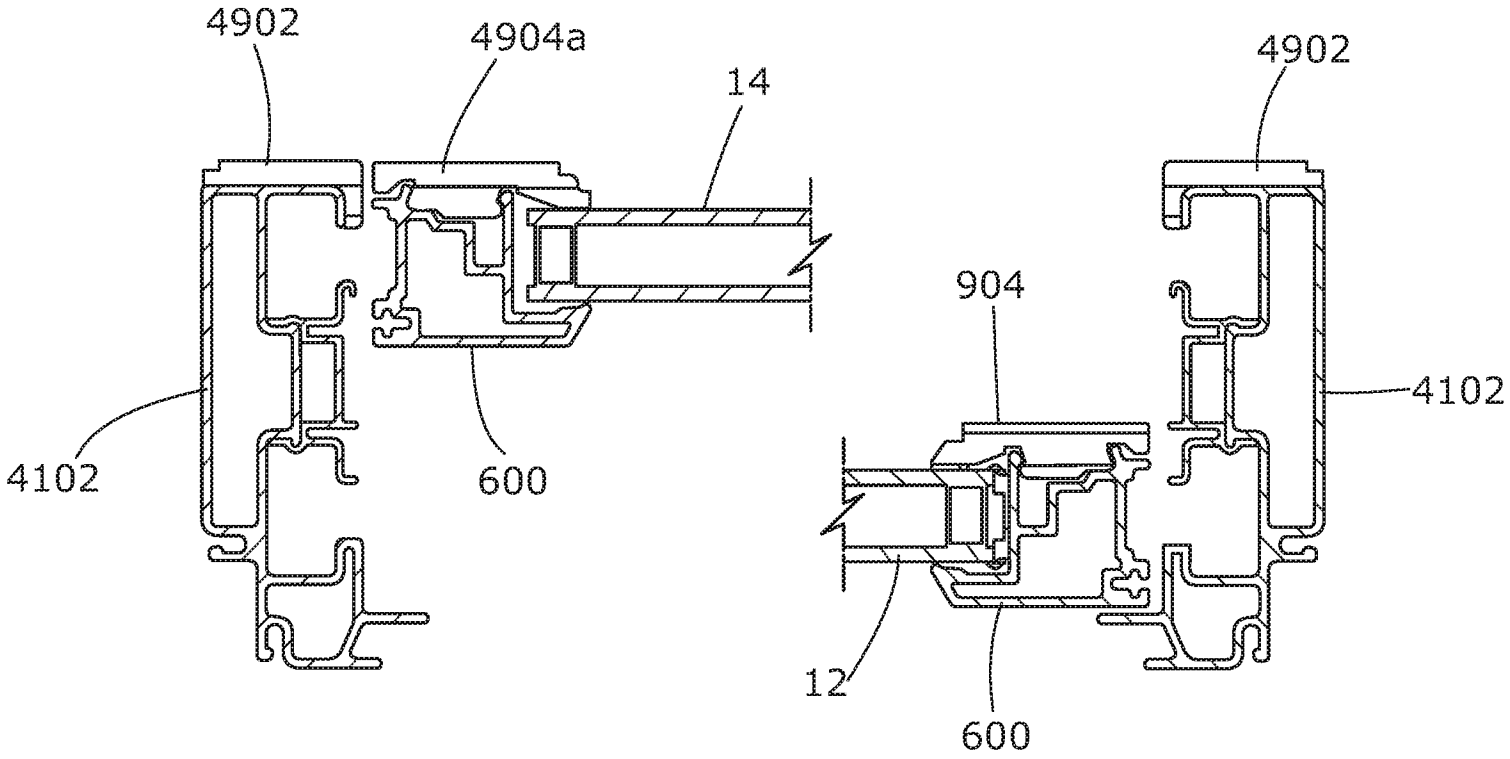
FIG. 6 is a cross-sectional view of a further embodiment of the assembled double hung window frame assembly of FIG. 1 along the lines B-B.

Referring briefly to FIGS. 5 and 6, there is shown an alternative configuration of a first profile member 4102. The first profile member 4102 is a simpler version of the first profile member 102 of FIGS. 4A and 4B. The first profile member 4102 comprises essentially the same features as first profile member 102 of FIGS. 4A and 4B. However, in this embodiment, the first profile member 4102 is not provided with the 'u'-shaped channel 117 as depicted in FIGS. 4A and 4B. Instead, a second segment 4110 directly adjoins a projection 4118 such that the second segment 4110 and the projection 4118 together form a linear extension. A cover member (e.g., ahead stop or side stop) 4902 is configured to seat about the linear extension comprising the second segment 4110 and the projection 4118.

Figure 7A:
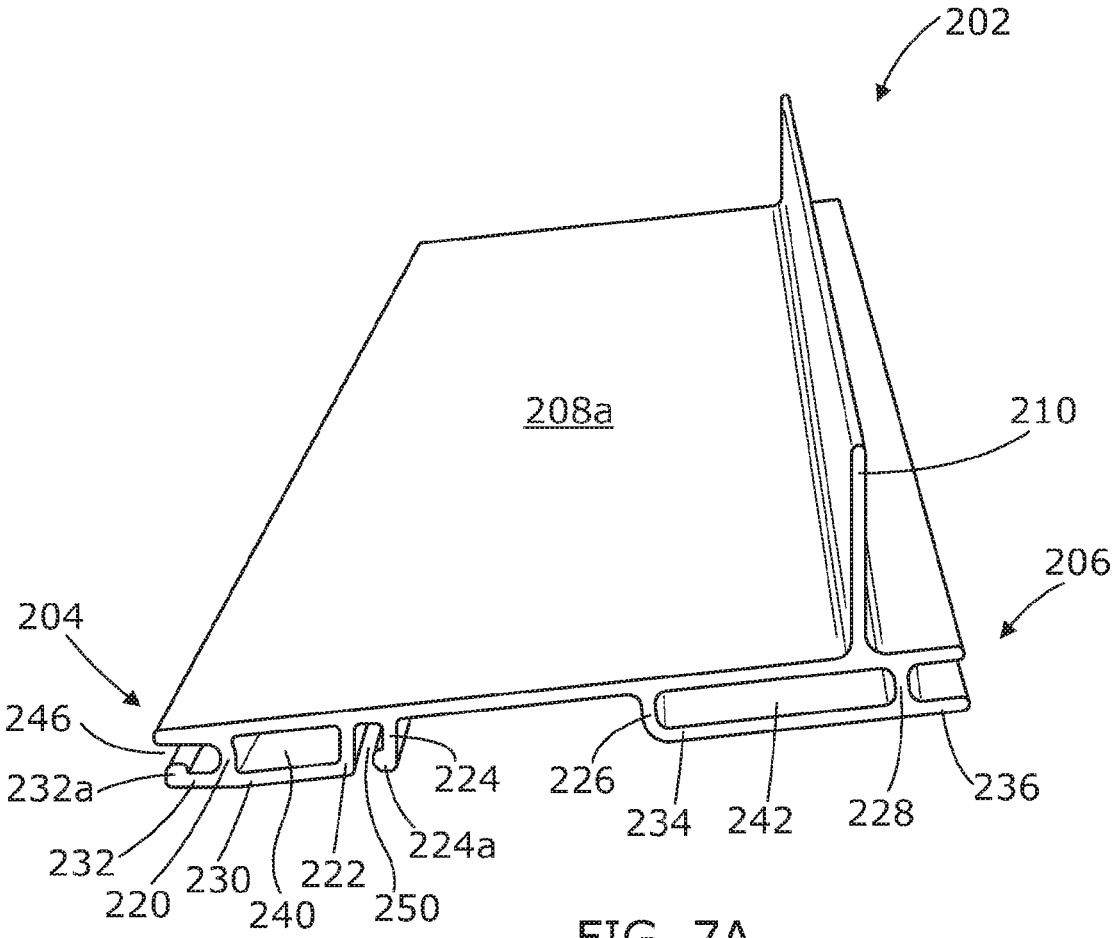
FIG. 7A is a perspective view of a second lineal member of the frame assembly of FIG. 1.
Figure 7B:
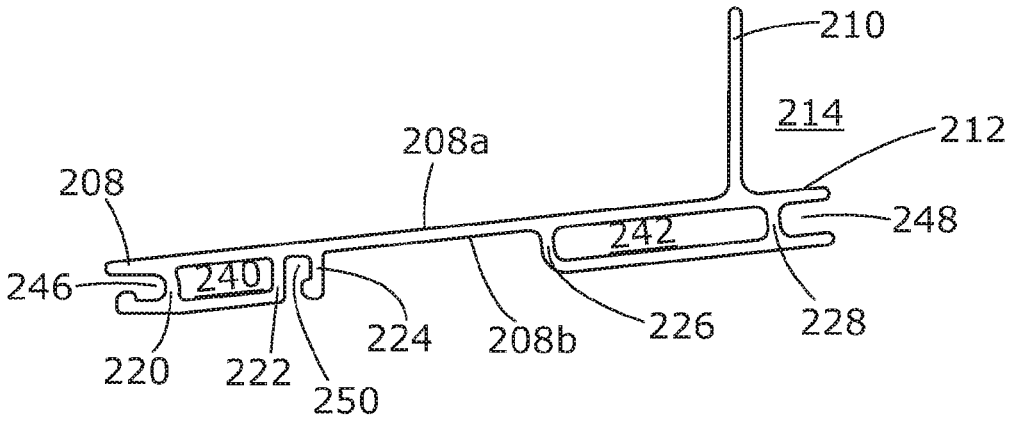
FIG. 7B is a side view of the second lineal member of the frame assembly of FIG. 7A.
Figure 8A:
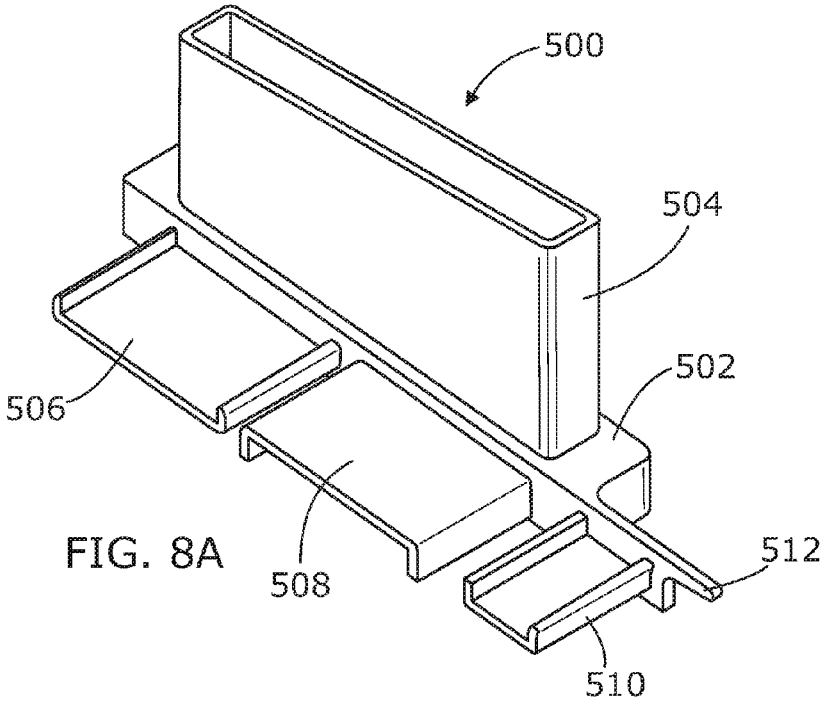
FIG. 8A is a perspective view of a first corner key member used to secure adjacent first and second lineal members of the frame assembly of FIG. 1 together.
Figure 8B:
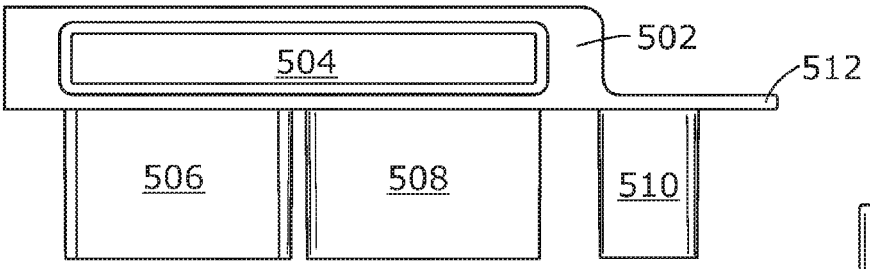
FIG. 8B is a top view of the first corner key member of FIG. 8A.
Figure 8D:
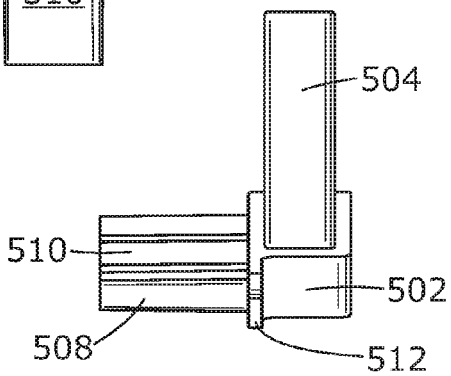
FIG. 8D is a rear view of the first corner key member of FIG. 8A.
Figure 8C:
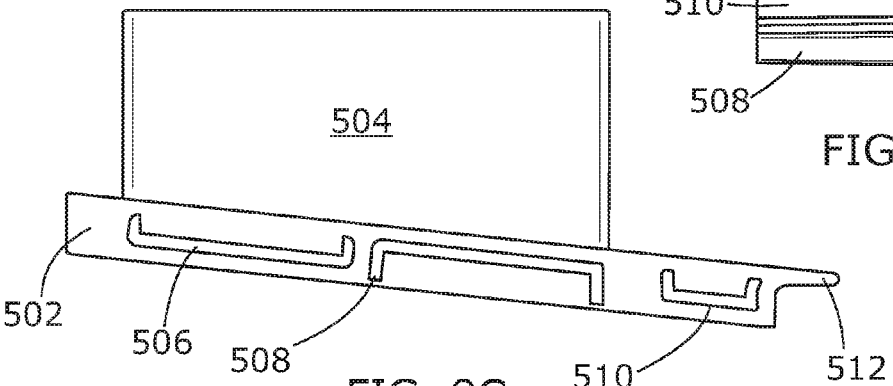
FIG. 8C is a side view of the first corner key member of FIG. 8A.

Referring now to FIGS. 7A and 7B, the second profile or sill profile 202 will now be described. The second or sill profile 202 is used in the sill jamb 200 of frame assembly 10 (FIG. 1) such that the sill profile 202 sits against the lower transverse section of the window opening as described above with reference to FIG. 1.

Similar to the first profile 102 described above, the sill profile 202 is an elongate profile which is sized and configured such that it can seat directly against a window opening in a new construction or where an existing window has been fully removed and is being replaced. The sill profile 202 is also sized and configured such that it is suitable for use where a drywall (sheet rock, gypsum board or plaster board) return or a jamb extension is retained in place when removing and replacing an existing window or a sash of an existing window frame.

In some embodiments, the sill profile 202 extends between approximately 3" (7.62 cm) and 3.5" (8.89 cm)±0.1" (2.54 cm) from an outermost end 204 to an innermost end 206. In one example embodiment, the sill profile 202 is sized such that the distance it extends between the outermost end 204 and the innermost end 206 corresponds to the distance that a pocket replacement window extends, that is, approximately 3.25" (8.26 cm). This allows an end user to fit the window frame assembly 10 inside an existing window frame.

The sill profile 202 comprises a substantially elongate planar portion 208 which has an upper surface 208*a* and a lower surface 208*b*.

A plurality of projections 220, 222, 224, 226, 228 extend substantially orthogonally from the lower surface 208*b* of the substantially elongate planar portion 208. A first projection 220 and a second projection 222 are contiguous with a first connecting member 230, which extends between the first and second projections 220, 222 substantially in parallel with the substantially elongate planar portion 208. The first connecting member 230 connects the first and second projections 220, 222 together to form a first opening 240. Similarly, a fourth projection 226 and a fifth projection 228 are contiguous with a second connecting member 234, which extends between the fourth and fifth projections 226 and 228 substantially in parallel with the substantially elongate planar portion 208. The second connecting member 234 connects the fourth and fifth projections 226 and 228 together to form a second opening 242.

In some embodiments, the openings 240 and 242 extend along the length of the sill profile 202 between opposing ends 200*a*, 200*b* (FIG. 1) of the sill jamb 200 to form an enclosed interior passage between opposing ends 200*a*, 200*b* of sill jamb 200 (FIG. 1). Similar to the enclosed interior passages of the head and side jambs 100, 300, and 400 respectively, it is possible for a portion of the enclosed passage to be filled with a suitable material, for example, an insulating material in order to enhance the thermal insulation or efficiency of the frame assembly 10 (FIG. 1). In such an embodiment, it may be preferable to form the openings 240, 242 at opposing ends of the sill profile 202, as will be described below.

A third projection 224 extends substantially orthogonally from the lower surface 208*b* of the substantially elongate planar portion 208. The third projection 224 extends substantially in parallel with the second projection 222, such that the second and third projections 222, 224 and a portion of the lower surface 208*b* of the substantially elongate planar portion 208 form an inverted elongate 'u'-shaped channel 250. The inverted elongate 'u'-shaped channel 250 is also known as a fin groove, similar to the fin groove depicted in FIG. 5, whereby the inverted elongate 'u'-shaped channel 250 is configured to receive a nailing fin member to secure the frame within a window opening. In the embodiment shown, the third projection 224 further comprises a flange 224*a* which is provided to help retain the nailing fin member within the inverted elongate 'u'-shaped channel 250 when in place. As before, the nailing fin member is inserted when desired by the end user when inserting a new window or an entire replacement window.

In some embodiments, wherein frame members 100, 200, 300 and 400 of frame assembly 10 (FIG. 1) are seated together to form the frame assembly 10, the position of the fin groove 133 of the first profile member 102 (FIGS. 4A and 4B) at the upper transverse section of the window frame assembly 10 is substantially in line with the position of the fin groove 250 of the second profile member 202 at the lower transverse section of the window frame assembly as seen in FIG. 2. The position of the fin groove 133 of the first profile member 102 when used in frame members 300, 400 (spaced apart parallel side jambs) is also substantially in line with the fin grooves 133, 250 of frame members 100, 200 (head and sill jambs). In this instance, if a nailing fin member is placed in each of the fin grooves 133, 250, each of the nailing fin members surrounding the frame assembly 10 will be in the same axial plane. In an alternate embodiment, not shown here, the position of one or more of the fin grooves 133, 250 on the first and second profile 102, 202 respectively can be positioned such that when in the frame assembly 10, one or more of fin grooves 133, 250 are out of alignment with the other of the fin grooves 133, 250. In this instance, if it is desired to bring the nailing fin members surrounding the frame assembly 10 into the same axial plane, one or more of the nailing fin members placed in the fin grooves 133, 250 can be stepped nailing fin members.

With continued reference to FIGS. 7A and 7B, the first connecting member 230 further comprises a first extension 232. The first extension 232 extends substantially in the same plane as the first connecting member 230. The first extension 232, the first projection 220, and a portion of the substantially elongate planar portion 208 together form an inverted 'c'-shaped elongate receiving channel 246. The inverted 'c'-shaped elongate receiving channel 246 is configured to seat other components or accessories within the window frame assembly 10 (FIG. 1). In one embodiment, other components or accessories include, for example, trim and/or frame expander devices or other suitable accessories known to a person skilled in the art. In one example, an end user may desire to insert an aluminum trim or a fiberglass frame expander.

The first extension 232 further comprises an obtrusion 232*a* which is used to help retain a component or accessory within the when one is placed within the inverted 'c'-shaped elongate receiving channel 246. The first extension 232 is slightly biased towards the lower surface 208*b* of the substantially elongate planar portion 208. This orientation of the first extension 232 provides a resilient fit for any of the other components or accessories that are suitable for placement in the inverted 'c'-shaped elongate receiving channel 246.

The second connecting member 234 further comprises a second extension 236. The second extension 236 extends substantially in the same plane as second connecting member 234. The second extension 234, the fifth projection 228, and a portion of the substantially elongate planar portion 208 together form a 'c'-shaped elongate receiving channel 248.

A flange 210 projects orthogonally or substantially orthogonally (e.g., between 75° and 90°) from the upper surface 208*a* of the substantially elongate planar portion 208. A section 212 of the substantially elongate planar portion 208 defines the base portion or leg of an elongate 'L'-shaped channel 214, wherein the flange 210 defines the upper portion or back of the elongate 'L'-shaped channel 214. The 'L'-shaped channel 214, together with the 'c'-shaped elongate receiving channel 248, are configured to a seat cover member (or sill stop) 910 as shown in FIG. 2. In some embodiments, the distance the sill profile 202 and the cover member 910 extend from the exterior side of the window frame assembly 10 (as shown in FIGS. 1 and 2) to the interior side of the window frame assembly 10 is between approximately 3.9" (9.9 cm) and 4.4" (11.2 cm)±0.1" (0.25 cm). In a further example embodiment, the distance jamb profile 202 and cover member 910 extend from the exterior side of the window frame assembly 10 to the interior side of the window frame assembly 10 is approximately 4.13" (10.5 cm).

Referring jointly to FIG. 2 and FIGS. 7A and 7B, when the sill profile 202 is placed in a frame assembly, it is possible to adjust the angle of the sill profile between approximately 0° and 14° (e.g., adjusting the angle between the flange 210 and the substantially elongate planar portion 208 between 76° and 90°) by altering the configuration of a cover member or sill stop 902. In one example, the cover member or sill stop 902 of FIG. 2 further comprises a wedge portion having a thick end which tapers to a thin edge. In use, the cover member or sill stop 902 seats in the 'L'-shaped channel 214 such that the wedge portion is seated under the substantially elongate planar portion 208 in abutment with at least the second connecting member 234, wherein the thick end of the wedge portion is adjacent to the innermost end 206. The degree to which the wedge portion tapers from the thick end to the thin edge is variable and is chosen to accommodate a sill profile with an angle between approximately 0° and 14°.

Referring again briefly to FIG. 5, there is shown an alternate second profile member 4202. The second profile member 4202 is a simpler version of the second profile member 202 shown in FIGS. 2, 7A, and 7B. The second profile member 4202 comprises first and second substantially elongate planar portions 4208, 4260. The first and second substantially elongate planar portions 4208, 4260 are spaced apart from each other by first and second end projections 4220, 4228. An intermediate projection 4226 is positioned between the first and second substantially elongate planar portions 4208, 4260, intermediate the first and second end projections 4220, 4228, so as to define openings 4240 and 4242. As before, openings 4240 and 4242 extend along the length of the second profile member 4202 between opposing ends of second profile member 4202 to form an enclosed interior passage between the opposing ends. The second profile member 4202 is also provided with an inverted 'c'-shaped elongate receiving channel 4246 to seat other components or accessories within the window frame assembly 10.

Referring now to FIGS. 2, 3, 5 and 6, cover members 902, 904, 906, 908, 910, 4902, 4904*a*, 4906, and 4910 each form part of the interior surface of a frame assembly 10 (FIG. 1). As previously mentioned, cover members 902, 4902 are also referred to as a head stop, and cover members 910, 4910 are also referred to as a sill stop.

Cover members 904, 4904*a* are referred to as the glazing stops. In general, cover members 904, 4904*a* form part of the window sash configuration and are used to retain the glass in position within the upper and lower sashes 12, 14.

Cover members 906 and 908 also form part of the window sash configuration and are often referred to as the meeting rails. Cover member 908 forms the lower transverse section of the window sash configuration for upper window sash 12. Cover member 908 also functions to retain glass in position within the upper window sash 12.

Cover member 906 forms part of the upper transverse section of the window sash configuration for lower window sash 14. Cover members 906 and 908 are configured to seat hardware normally associated with window assemblies, such as, for example window locks or window handles or pulls. It is also possible to seat window handles or pulls on cover members 904, 4904*a* if so desired.

In some embodiments, cover members 904 are configured to conform to the other cover members of the window frame assembly 10 to form an aesthetically pleasing finish. It is possible for each of the cover members 902, 904, 910 to include for example, chamfering details to provide a more ornate finish. An example of such detail is shown, for example, in cover member 4904*a*, as shown in FIG. 6.

Each of cover members 902, 904, 906, 908, 910, 4902, 4904*a*, 4906, and 4910 are secured to the respective profile member using either chemical or mechanical fastening methods to form an aesthetically pleasing finish on the window frame assembly 10. In some embodiments, the cover member is secured to a profile member using an appropriate adhesive or glue. In some embodiments, the cover member is secured to a profile member using appropriate mechanical fasteners, such as, for example, staples, nails, or the like. It is also possible for the cover member to be configured such that the size and shape of the cover member provides a resilient fit to the appropriate profile member. For example, in the instance where cover member 902 provides a resilient fit to the jamb member 102, the cover member 902 is described as having a 'snap fit' to the jamb member 102. In further embodiments, a combination of fastening methods can be used to secure the cover member to the appropriate profile member. For example, where cover member 902 has a 'snap-fit' to jamb member 102, an appropriate adhesive could also be used to further secure the cover member 902 to the jamb member 102.

In some embodiments, each of cover members 902, 904, 906, 908, 910, 4902, 4904*a*, 4906, and 4910 are formed from a suitable solid wood, for example, pine. In an alternate embodiment, cover members 902, 904, 906, 908, 910, 4902, 4904*a*, 4906, and 4910 are formed from any other suitable material such as, for example, veneered wood, fiberglass, veneered fiberglass, vinyl or aluminum. The material of each cover member 902, 904, 906, 908, 910, 4902, 4904*a*, 4906, and 4910 can be selected by the end user such that the interior surface of the frame assembly is aesthetically pleasing for the end user.

Profile connecting members 800 and 808 are each configured to seat over the substantially 'c'-shaped section 114*b* of the first profile 102. Specifically, the profile connecting member 800 seats over the 'c'-shaped section 114*b* of the first profile 102 when the first profile 102 is used as the head jamb 100 of FIG. 1. Referring briefly to FIG. 5, there is shown an alternative configuration of a profile connecting member 4800 seated on a first profile member 4102. The profile connecting member 808 seats over the 'c'-shaped section 114*b* of the first profile 102 when the first profile 102 is used as a side jamb 300, 400 of FIG. 1. The size and shape of the first end of each of profile connecting members 800, 808 is such that a 'snap-fit' is formed over the enlarged first end 125 of planar member 126 and nub 129*a* at the second end 129 of the planar member 126.

The opposing ends of each of the profile connecting members 800, 808 are configured to provide a sash stop, wherein the movement of each of the upper and lower window sash 12, 14 is restricted such that the upper window sash 12 and the lower window sash 14 are able to slide between at least two positions to open or close the window frame assembly.

The opposing end of the profile connecting member 800 is configured such that the lower window sash 14 within the window frame assembly 10 (FIG. 1) is stopped by the profile connecting member 800. The opposing end of the profile connecting member 800 also functions to retain the upper window sash 12 within the window frame assembly 10 (FIG. 1) such that it is retained in the correct orientation in parallel with the lower window sash 14. Conveniently, weather strips 700 are also provided to control the gap between the upper window sash 12 and the opposing end of the profile connecting member 800.

Profile connecting members 802, 804 attach to cover members 906 and 908 and also form part of the window sash configuration. The profile connecting member 804 forms part of the lower transverse section of the window sash configuration for the upper window sash 12. The profile connecting member 802 forms part of the upper transverse section of the window sash configuration for the lower window sash 14. The profile connecting member 806 is also known as the bottom rail extender and provides an aesthetic finish for the window frame assembly 10 (FIG. 1).

Each of profile connecting members 800, 802, 804, 806, and 808 can be formed from any suitable material known to a person skilled in the art, such as, for example vinyl.

The upper sash 12 and the lower sash 14 each comprise components normally associated with sash windows. The sash profile 600 also functions as a glazing stop. Each of the sash profile 600 and the cover members 904, 4904*a*, 908 are configured to seat together such that each of the sash profile 600 and the cover members 904, 4904*a*, 908 operate together to retain glass within the upper and lower sashes 12, 14.

Referring now to FIGS. 8A to 10B, three different corner keys 500, 550, and 570 are shown. The corner keys 500, 550, and 570 are configured for use with the first and second profile members 102, 202 depicted elsewhere herein.

Referring specifically to FIGS. 8A to 8D, and with reference to FIG. 1, a first corner key 500 is sized and configured to seat at corner 200*a* of the frame assembly 10, connecting the sill profile 200 with the side jamb profile member 400. The first corner key 500 comprises a base member 502 from which an arm 504 extends. The arm 504 is configured to seat within the opening 116 of the first profile 102, as depicted in FIGS. 4A and 4B. The arm 504 is shaped such that when the first corner key 500 is seated within the opening 116 of first profile 102 (FIGS. 4A and 4B), base 502 is angled to the same degree as the second profile 202 (as shown in FIGS. 7A and 7B).

The first corner key 500 further comprises a plurality of projecting members 506, 508, and 510, which also extend from the base member 502. Projecting member 510 extends from an extension 512 of the base member 502. Projecting members 506, 508 and 510 are substantially orientated such that they are perpendicular to arm 504. Projecting members 506 and 510 are configured to seat within openings 240 and 242 of the second profile 202 (FIGS. 7A and 7B), whilst projecting member 508 is configured to seat within the opening between third and fourth projections 224 and 226 of second profile 202. Although not shown, it is understood that the position of the projecting members 506, 508 and 510 will be reversed such that projecting members 506, 508 and 510 project from the opposing side of base 502 to connect sill profile 200 with side member 300 at corner 200*b* of frame assembly 10 (FIG. 1).

Figure 9A:
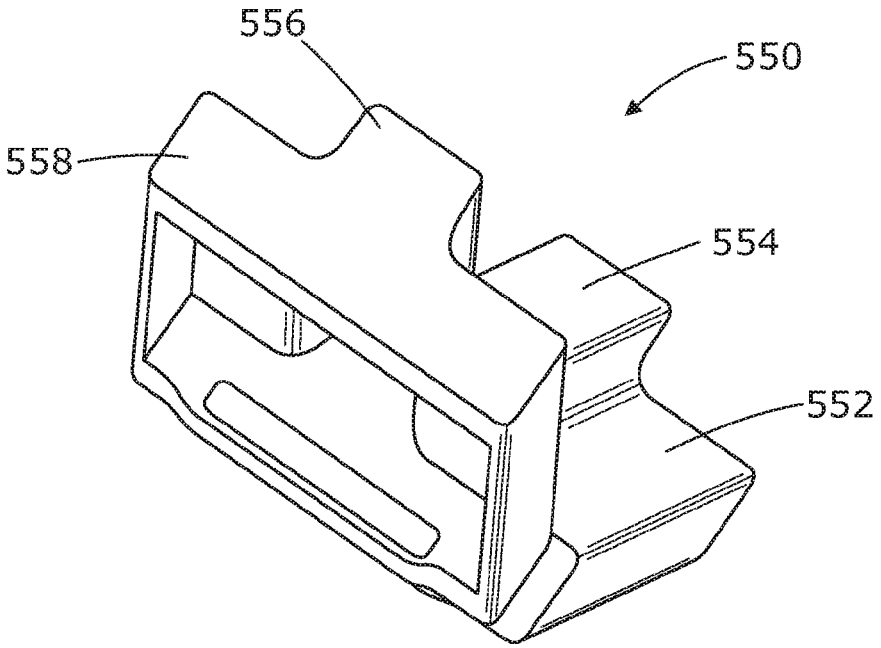
FIG. 9A is a perspective view of a second corner key member used to secure adjacent first lineal members of the frame assembly of FIG. 1 together.
Figure 9B:
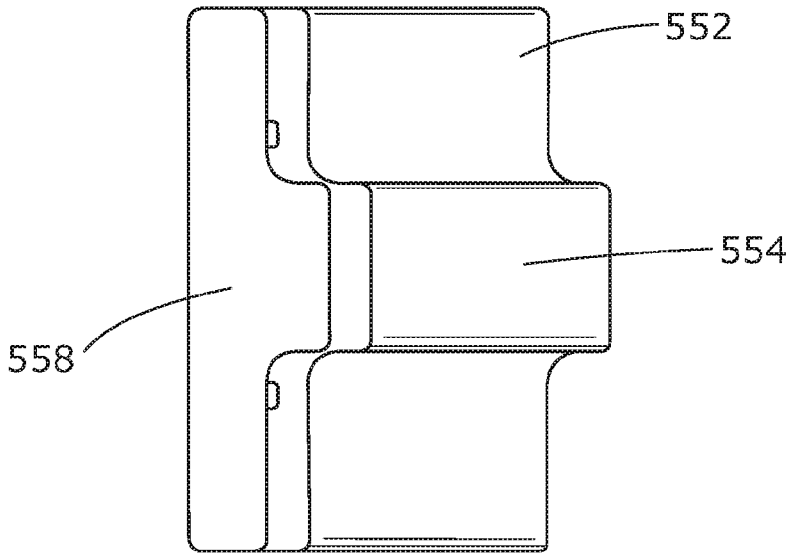
FIG. 9B is a top view of the first corner key member of FIG. 9A.

Referring now to FIGS. 9A and 9B, and with continued reference to FIGS. 1, 4A, and 4B, there is shown a second corner key 550 which corresponds to an inner corner key when connecting the head jamb profile 100 with either of the side jamb profile members 300, 400. The inner corner key 550 is sized and shaped to seat within the opening 116 of the first profile 102. The inner corner key 550 comprises a first section 552 and a second section 558, which are configured to be substantially orthogonal to each other. Each of first and second sections 552 and 558 comprise engaging members 554 and 556, respectively. The engaging members 554 and 556 are sized and shaped to seat within the substantially 'c'-shaped section 114*b* of opening 116.

Figure 10A:
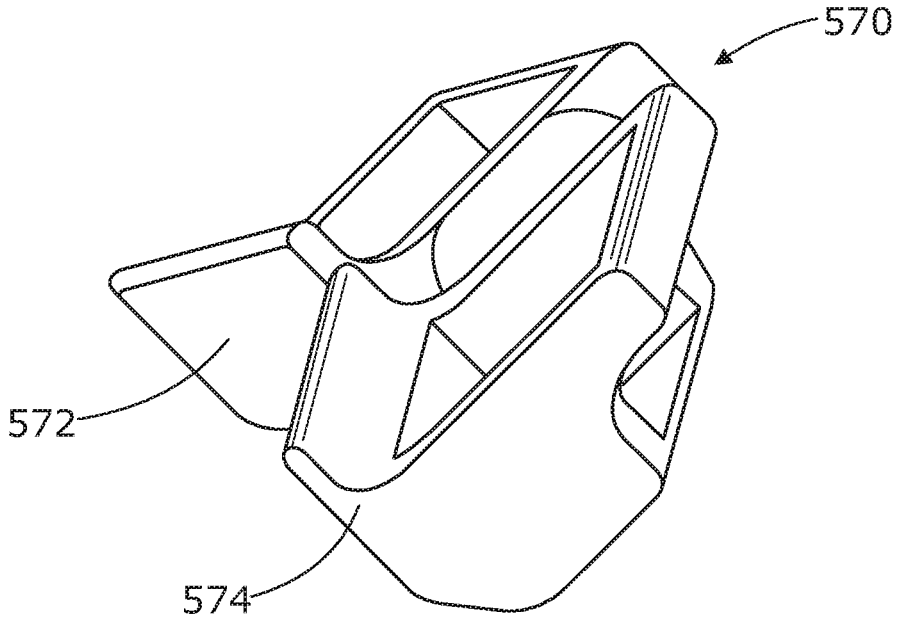
FIG. 10A is a perspective view of a third corner key member used to secure adjacent first lineal members of the frame assembly of FIG. 1 together.
Figure 10B:
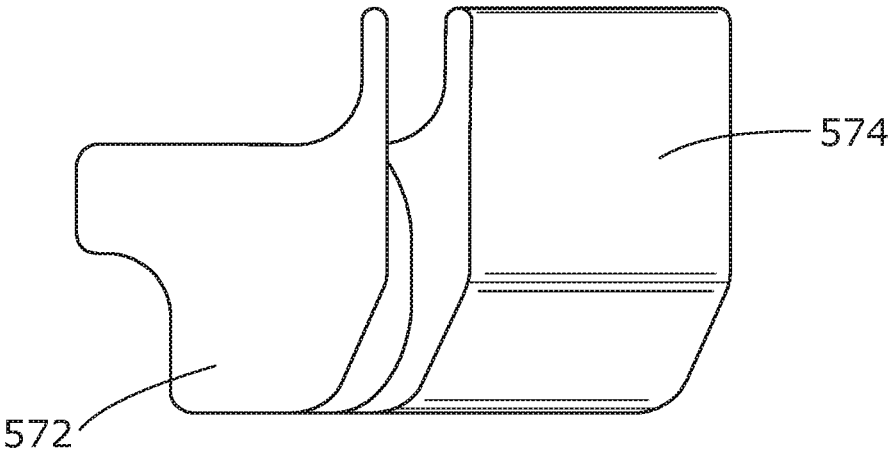
FIG. 10B is a side view of the first corner key member of FIG. 10A.

Referring now to FIGS. 10A and 10B, and with continued reference to FIGS. 1, 4A, and 4B, there is shown a third corner key 570 which corresponds to an outer frame corner key. The third corner key 570 is also sized and configured to seat at corners 100*a* and 100*b* of frame assembly 10 connecting the head jamb profile 100 with the side jamb profile members 300, 400. The third corner key 570 comprises two connecting sections, a first section 572 and a second section 574. The first and second sections 572, 574 are sized and shaped to seat within the opening 130 of the first profile 102.

Each of the corner keys 500, 550, 570 described herein can be configured to snap-fit or friction-fit into their respective openings 116, 130, 240 and 242. In some instances, adhesive may also be applied to the corner keys 500, 550, 570 whilst in position within openings 116, 130, 240 and 242 to provide a better seal between adjacent frame members 100, 200, 300, 400. Use of corner keys, 500, 550, 570 whilst not essential, saves time when assembling frame assembly 10. In addition, the use of corner keys 500, 550, 570 may provide additional dimensional stability, enhancing the structural strength of a window frame 10 assembled from the frame members 100, 200, 300, 400.

As outlined above the present disclosure describes a first and second profile 102, 202 which comprise component parts of a window frame assembly 10.

In use, the window frame assembly 10 is configured to accommodate insertion of a new window in a window opening of a new construction by inclusion of a nailing fin member within one or more of the fin grooves 133, 250 of first and second profile 102, 202 respectively. This embodiment of the window frame assembly 10 is also suitable for use in the instance where a replacement window is called for and the external surface of the building is being re-sided. Optionally, if the distance each of the first and second profiles 102, 202 extend from the outermost end to the innermost end of the window frame assembly 10 is less that the actual distance from the outermost end to the innermost end of the window frame assembly 10, wherein the outermost end is located on the exterior side of the window frame assembly and the innermost end is located on the interior side of the window frame assembly when the window frame is installed in a building opening, an extension member is used to finish trimming the window frame assembly 10.

The window frame assembly 10 is also configured to accommodate insertion of a window, where an existing window has been fully removed and is being replaced. In this instance the ability to adjust the angle of the sill profile 202 to have a flat sill and the ability to use the window frame assembly 10 without a nailing fin member in position enables an end user to insert the window frame assembly 10 easily without disturbing the exterior or interior surface of the building.

The window frame assembly 10 is also configured to accommodate insertion of a pocket replacement window wherein the window is manufactured to fit inside an existing window frame or insertion of a pocket replacement window wherein the window is manufactured to fit inside an existing window frame wherein a drywall (sheet rock, gypsum board or plaster board) return or a jamb extension is retained in place. In this instance the distance that each of the first and second profiles 102, 202 extend from the outermost end to the innermost end of the window frame assembly 10 and the ability to adjust the angle of the sill profile 202 enable an end user to insert the window frame assembly 10 within the existing window frame.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Although making and using various embodiments are discussed in detail below, it should be appreciated that the description provides many inventive concepts that may be embodied in a wide variety of contexts. The specific aspects and embodiments discussed herein are merely illustrative of ways to make and use the systems and methods disclosed herein and do not limit the scope of the disclosure. The systems and methods described herein may be used for formation of window frame assemblies and are described herein with reference to this application. However, it will be appreciated that the disclosure is not limited to this particular field of use.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A universal window frame assembly comprising:

a head jamb comprising a first lineal member having a first cross-sectional profile, wherein the first cross-sectional profile includes:

a first opening comprising a first enclosed interior passage proximate an exterior edge of the first cross-sectional profile and configured to receive a corner key arm having a first complementary profile;

a second opening defined in part by a first planar section configured to lie adjacent to an inward facing surface of a window opening and by first and second perpendicular segments contiguous with and perpendicular to the first planar section, the second opening comprising a second enclosed interior passage proximate an interior edge of the first cross-sectional profile and configured to receive a corner key having a second complementary profile, the interior edge disposed opposite the first cross-sectional profile from the exterior edge along a depth of the window frame assembly;

a partially enclosed fin groove defined in part by the first perpendicular segment such that the fin groove is adjacent to the second opening along the depth, the fin groove opening outward relative to the window frame assembly and configured to securably receive a nailing fin; and an interior facing channel defined in part by the second perpendicular segment and the first planar section;

a sill jamb comprising a second lineal member having a second cross-sectional profile, wherein the second cross-sectional profile includes:

a planar sill member configured to form an upper surface of the sill jamb, the planar sill member having an exterior end and an interior end;

at least one opening disposed below the planar sill member;

a flange extending upward from the planar sill member at a position spaced between the exterior end and the interior end, wherein the flange and the sill member intersect at a sill angle; and a fin groove configured to securably receive a nailing fin;

a plurality of side jambs comprising a third lineal member and a fourth lineal member, the third and fourth lineal members each having the first cross-sectional profile; and a plurality of corner keys, each corner key comprising a first arm configured to seat within one of the first opening or the second opening of the first cross-sectional profile, and a second arm orthogonal to the first arm, the corner keys including:

at least one sill corner key in which the second arm is configured to seat within the at least one opening of the second cross-sectional profile to orthogonally couple the sill jamb to one of the two side jambs;

at least one first head corner key having the first and second arms each configured to seat within the first opening of the first cross-sectional profile to orthogonally couple the head jamb to one of the two side jambs; and at least one second head corner key having the first and second arms each configured to seat within the second opening of the first cross-sectional profile to orthogonally couple the head jamb to one of the two side jambs.

2. The universal window frame assembly of claim 1, further comprising a plurality of cover members, each cover member coupled to an inner end of the head jamb, the sill jamb, or one of the side jambs, to form an aesthetically pleasing finish.

3. The universal window frame assembly of claim 1, wherein the universal window frame assembly is configured to be installed in any of a new construction window, a full frame window replacement, or a pocket window replacement.

4. The universal window frame assembly of claim 1, wherein the head jamb, the sill jamb, the side jambs, and the corner keys form a substantially rigid rectangular window frame sized and shaped to receive and support one or more slidable window sashes.

5. A window frame assembly system comprising:

a head jamb having a first length defined by a first end and a second end, the head jamb comprising a first cross-sectional profile, the first cross-sectional profile including:

a first opening comprising a first enclosed interior passage proximate an exterior edge of the first cross-sectional profile and configured to receive a corner key arm having a first complementary profile;

a second opening defined in part by a first planar section configured to lie adjacent to an inward facing surface of a window opening and by first and second perpendicular segments contiguous with and perpendicular to the first planar section, the second opening comprising a second enclosed interior passage proximate an interior edge of the first cross-sectional profile and configured to receive a corner key arm having a second complementary profile, the interior edge disposed opposite the first cross-sectional profile from the exterior edge along a depth of the window frame assembly;

a partially enclosed fin groove defined in part by the first perpendicular segment such that the fin groove is adjacent to the second opening along the depth, the fin groove opening outward relative to the window frame assembly to securably receive a nailing fin of the window opening; and an interior facing channel defined in part by the second perpendicular segment and the first planar section;

a plurality of side jambs, each side jamb having a second length defined by a top end and a bottom end, each side jamb comprising the first cross-sectional profile;

a sill jamb having a first end and a second end defining a length equal to the first length, the sill jamb comprising a second cross-sectional profile; and a plurality of corner keys, each corner key comprising a first arm and a second arm orthogonal to the first arm, the plurality of corner keys comprising:

at least one first head corner key having the first and second arms each configured to seat within the first opening of the first cross-sectional profile to orthogonally couple the head jamb to one of the plurality of side jambs; and at least one second head corner key having the first and second arms each configured to seat within the second opening of the first cross-sectional profile to orthogonally couple the head jamb to one of the plurality of side jambs.

6. The window frame assembly system of claim 5, wherein the plurality of corner keys comprise at least one sill corner key and at least one head corner key, wherein the second arm of each sill corner key is sized and shaped to fit within an opening of the second profile, and wherein the second arm of each head corner key is sized and shaped to fit within an opening of the first profile.

7. The window frame assembly system of claim 5, wherein the first arm of each corner key is configured to form a friction-fit connection when inserted into the opening of the first profile.

8. The window frame assembly system of claim 5, wherein the head jamb, the side jambs, and the sill jamb each have a depth defined by an interior end and an exterior end, wherein the depth is between approximately 3 inches and 3.5 inches.

9. The window frame assembly system of claim 5, further comprising one or more cover members configured to couple to an interior surface of at least one of the head jamb, the sill jamb, or the side jambs to form an aesthetically pleasing finish.

10. The window frame assembly system of claim 9, wherein the one or more cover members comprise a sill stop configured to couple to the sill jamb, and wherein a slope angle of at least a portion of the sill jamb is determined by one or more dimensions of the sill stop.

11. The window frame assembly system of claim 5, wherein the head jamb, the sill jamb, the side jambs, and the plurality of corner keys are configured, when assembled, to form a substantially rigid rectangular window frame sized and shaped to receive and support one or more slidable window sashes.

12. The window frame assembly of claim 5, wherein the sill jamb has a sill slope angle between 4° and 14°.

13. A window frame assembly comprising:

a head jamb having a first end and a second end;

a plurality of side jambs, each side jamb having a top end and a bottom end, each top end coupled, by a first head corner key and a second head corner key, to the first end or the second end of the head jamb; and a sill jamb having a first end and a second end, each of the first end and the second end of the sill jamb being coupled to the bottom end of one of the plurality of side jambs by a sill corner key;

wherein each of the head jamb and the side jambs comprises an elongate member having a first cross-sectional profile, the first cross-sectional profile including:

a first opening comprising a first enclosed interior passage proximate an exterior edge of the first cross-sectional profile and configured to receive a corner key arm having a first complementary profile;

a second opening defined in part by a first planar section configured to lie adjacent to an inward facing surface of a window opening and by first and second perpendicular segments contiguous with and perpendicular to the first section, the second opening comprising a second enclosed interior passage proximate an interior edge of the first cross-sectional profile and configured to receive a corner key arm having a second complementary profile, the interior edge disposed opposite the first cross-sectional profile from the exterior edge along a depth of the window frame assembly;

a partially enclosed fin groove defined in part by the first perpendicular segment such that the fin groove is adjacent to the second opening along the depth, the fin groove opening outward relative to the window frame assembly to securably receive a nailing fin of the window opening; and an interior facing channel defined in part by the second perpendicular segment and the first planar section;

wherein the sill jamb comprises an elongate member having a second profile different from the first profile; and wherein each first head corner key comprises two arms configured to seat within the first opening of the first cross-sectional profile, and each second head corner key comprises two arms configured to seat within the second opening of the first cross-sectional profile.

14. The window frame assembly of claim 13, further comprising a sill stop coupled to the sill jamb, wherein the sill stop is sized and shaped to determine a slope angle of at least a portion of the sill jamb.

15. The window frame assembly of claim 13, wherein each of the head jamb, the side jambs, and the sill jamb comprises an interior end an exterior end, the interior end and the exterior end being spaced apart by a distance between approximately 3 inches and 3.5 inches.

16. The window frame assembly of claim 13, wherein the head jamb, the side jambs, and the sill jamb are coupled by gluing or welding.

* * * * *